US005558965A

United States Patent [19]

Nguyen et al.

[11] Patent Number: 5,558,965

[45] Date of Patent: Sep. 24, 1996

[54] DIIMINOQUINILIDINES AS ELECTRON TRANSPORT AGENTS IN ELECTROPHOTOGRAPHIC ELEMENTS

[75] Inventors: Khe C. Nguyen, Los Altos; Sivapackia Ganapathiappan, Fremont, both of Calif.

[73] Assignee: Hewlett-Packard Company, Palo Alto, Calif.

[21] Appl. No.: 576,233

[22] Filed: Dec. 21, 1995

[51] Int. Cl.[6] ..... G03G 5/047; G03G 5/09

[52] U.S. Cl. ..... 430/58; 430/83; 430/132; 430/133

[58] Field of Search ..... 430/58, 83, 132, 430/133

[56] References Cited

U.S. PATENT DOCUMENTS 4,578,334 3/1986 Borsenberger et al. ..... 430/59
4,927,727 5/1990 Rimai et al. ..... 430/99
4,968,578 11/1990 Light et al. ..... 430/126
5,013,849 5/1991 Rule et al. ..... 549/28
5,034,293 7/1991 Rule et al. ..... 430/58
5,037,718 8/1991 Light et al. ..... 430/126
5,213,923 5/1993 Yokoyama et al. ..... 430/58
5,284,731 2/1994 Tyagi et al. ..... 430/126

*Primary Examiner*—Roland Martin

[57] ABSTRACT

Derivatives of diiminoquinilidines are useful as electron transport agents in electrophotography. The diiminoquinilidine derivatives are inexpensive materials, requiring only two steps to synthesize, have excellent solubility and compatibility with most binders due to the presence of long alkyl chains, and evidence high electron mobility.

20 Claims, 2 Drawing Sheets

DIIMINOQUINILIDINES AS ELECTRON TRANSPORT AGENTS IN ELECTROPHOTOGRAPHIC ELEMENTS

TECHNICAL FIELD

The present invention relates generally to electrophotographic printing, and, more particularly, to specific electron transport agents useful in electrophotographic printing.

BACKGROUND ART

Electrophotographic (EP) laser printing employs a toner containing pigment components and thermoplastic components for transferring a latent image formed on selected areas of the surface of an insulating, photoconducting material to an image receiver, such as plain paper, coated paper, transparent substrate (conducting or insulative), or an intermediate transfer medium.

There is a demand in the laser printer industry for multicolored images. The image quality can be enhanced by a large number of approaches, including the technique which utilizes small particle developer including dry toner having an average particle size less than 5 μm; see, e.g., U.S. Pat. Nos. 4,927,727; 4,968,578; 5,037,718; and 5,284,731. However, it has also been known that the electrophotographic dry toner having particle size less than 1 μm is very hard to prepare due to increased specific area, and consequently, liquid toner has become one of the solutions for practical preparation of sub-micrometer xerographic developer.

Liquid toners comprise pigment components and thermoplastic components dispersed in a liquid carrier medium, usually special hydrocarbon liquids. With liquid toners, it has been discovered that the basic printing color (yellow, magenta, cyan, and black) may be applied sequentially to a photoconductor surface, and from there to a sheet of paper or intermediate transfer medium to produce a multi-colored image.

The organic photoconductor products in the market today, generally speaking, are dual layer OPCs, which comprise a charge generation layer (CGL) and a charge transport layer (CTL) as key components. In addition to these layers, the photoconductor body can be undercoated or overcoated with other materials to improve adhesion to the substrate or to improve surface wear resistance or to reduce the surface adhesion for improved image transfer efficiency. The organic photoconductor (OPC) with an additional undercoating layer or overcoating layer becomes an organic photoreceptor (OPR) and ready for use in various designs of electrophotographic systems.

Most of the multilayer OPRs in the market are negative charging OPCs in which a thick hole transport layer is located on the top of a thin CGL. This is called the standard, or conventional, dual layer OPC. In the conventional case, the CGL usually comprises a photoconductive pigment or dye dispersed in an inert binder, with a pigment/dye content ranging up to about 90 wt %. 100% pigment in the CGL is possible where the pigment CGL is vacuum-evaporated in the format of a thin film; see, e.g., U.S. Pat. No. 4,578,334. Besides dispersion stabilizing functions, the CGL binder also plays an important role of adhesion.

Positive charging OPCs are also known, in which a thick electron transport layer is located on top of the thin CGL. Electron transport molecules are molecules which can transport an electron under a positive bias.

The advantages of the electron transport agent can be found in the design of a positive charging photoreceptor, in which the major carrier is the electron. In this design, the electron transport agent is also expected to provide excellent electrical stability of the photoreceptor, since it exhibits the least surface charge injection.

On the other hand, the challenges of the design of the electron transport molecules are associated with the solubility and the compatibility in various types of binders, inasmuch as electron transport agents, in general, are bulky.

A variety of electron transport agents have been disclosed, including derivatives of 4-thiopyran, dicyanofluorenone, imines, diphenobenzoquinone, and stilbene diphenobenzoquinone; see, e.g., U.S. Pat. Nos. 5,013,849; 5,034,293; and 5,213,923. However, 4-thiopyrans are expensive, most of the afore-mentioned compounds evidence poor compatibility with binders used to form the CTL, and most of these compounds suffer from a limited electron mobility range.

Thus, an electron transport agent is required which avoids most, if not all, of the problems associated with prior art electron transport agents.

DISCLOSURE OF INVENTION

In accordance with the invention, derivatives of diiminoquinilidines are effective as electron transport agents. The diiminoquinilidines of the present invention are represented by formula (I):

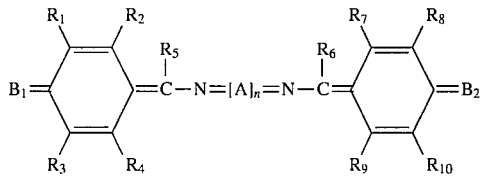

(I)

where A is a moiety selected from the group consisting of =CH—CH=,

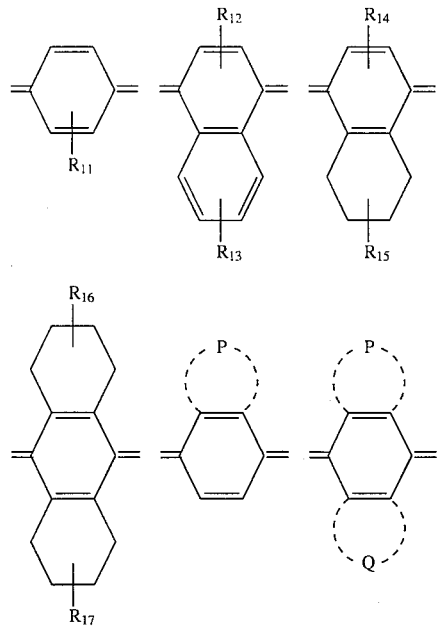

-continued

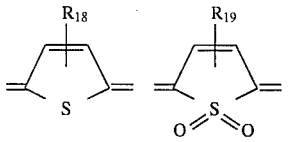

$B_1$ and $B_2$ are independently selected from the group consisting of O, S, Se, Te, dicyano, and alkoxy, and $R_1$ to $R_{20}$ are independently selected from the group consisting of alkyl, alkene, aryl, hydroxy, halogen, cyano, nitro, and sulfuryl, n is an integer within the range of 0 to 3, and

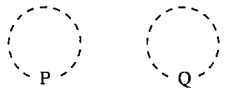

are independently selected from the group consisting of

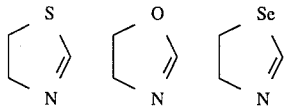

and where n is an integer of 0, 1, or 2.

The diiminoquininilidine derivatives of the invention are inexpensive materials, requiring only two steps to synthesize, have excellent solubility and compatibility with most binders due to the presence of long alkyl chains (n=0,1,2).

BEST MODES FOR CARRYING OUT THE INVENTION

Figure 1:
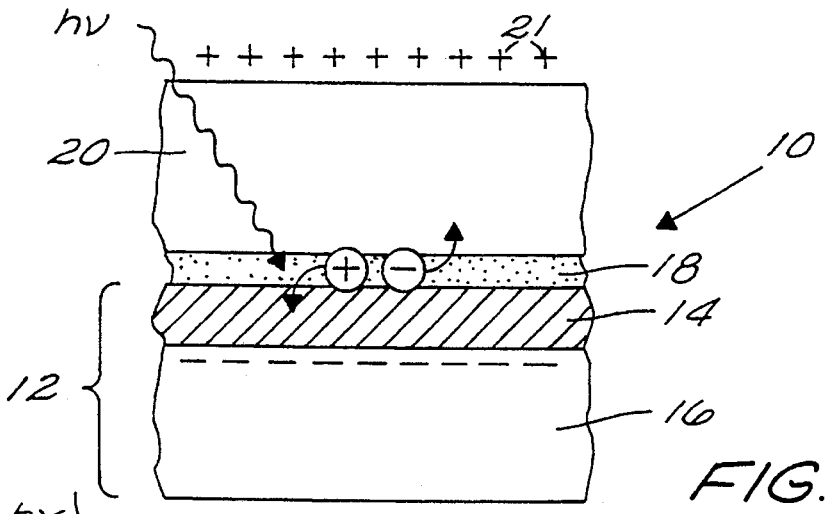
FIG. 1 is a cross-sectional view of one embodiment of a photoconductive generation and transport configuration, using the electron transport agents of the present invention.

Turning now to the drawings wherein like numerals of reference depict like elements throughout, FIG. 1 depicts one photoconductive generation and transport configuration 10, in which the electron transport agents of the present invention find use. In this embodiment, a conductive support 12 comprises an electrically conductive layer 14, typically of aluminum, formed on a substrate 16, such as a web or subbing layer to improve adhesion to an underlying web (not shown). The web, e.g., drum, is used as a component in electrophotographic printers and copiers, as is well-known.

A charge generation layer (CGL) 18 is formed on the electrically conductive layer 14. The CGL 18 typically comprises a photoconductive pigment or dye, either dispersed in a binder or deposited as a thin film, or other well-known photoconducting inorganic material, including amorphous selenium (a-Se), a-$As_2Se_3$, a-AsSeTe, amorphous Si, ZnO, CdS, and $TiO_2$.

Examples of suitable photoconductive pigments and dyes include:

(a) the metastable form of phthalocyanine pigments: x-form, tau-form of metal-free phthalocyanine pigment (x-$H_2$Pc), alpha-, epsilon-, beta-form of copper phthalocyanine pigment (CuPc), titanyl phthalocyanine pigments ($TiOPcX_4$, where X is H, F, Cl, Br, I), vanadyl phthalocyanine pigment (VOPc), magnesium phthalocyanine pigment (MgPc), zinc phthalocyanine pigment (ZnPc), chloroindium phthalocyanine pigment (ClInPc), bromoindium phthalocyanine pigment (BrInPc), chloroaluminum phthalocyanine pigment (ClAlPc), hydroxy gallium phthalocyanine, and the like;

(b) pyrollo pyrole pigments;

(c) tetracarboximide perylene pigments;

(d) anthanthrone pigments;

(e) bis-azo, -trisazo, and-tetrakisazo pigments;

(f) zinc oxide pigment;

(g) cadmium sulfide pigment;

(h) hexagonal selenium;

(i) squarylium dyes; and (j) pyrilium dyes.

Examples of suitable binders for the pigments and dyes include polyvinyl carbazoles, polystyrenes, polysilanes, polycarbonates, polyimides, polygermanes, polyesters, polyvinyl butyral (PVB), fluoropolymers, silicone resins, and other such materials well-known in this art. Additional suitable binders include thermoset and thermoplastic polymers having a large degree of flexibility in the polymer conformation due to its flexible backbone, and having a glass transition temperature lower than about 120° C., as disclosed in co-pending application Ser. No. 08/287,437, filed Aug. 8, 1994, entitled "Reusable Inverse Composite Dual-Layer Organic Photoconductor Using Specific Polymers Available for Diffusion Coating Process with Non-Chlorinated Solvents vents" by Khe C. Nguyen et al and assigned to the same assignee as the present application. These additional binders comprise specific vinyl polymers. In use, the concentration range of the pigment or dye in the binder ranges from about 10 to 80 wt %.

The charge generation layer 18 can also be a thin film of the above-mentioned photoconductive materials. The thin film charge generation layer 18 is conveniently prepared by vacuum technology techniques, including vacuum evaporation, sputtering, glow discharge, and the like. If such thin films are used, then no binders are required.

In use, the concentration range of the electron transport agent of the present invention in the binder ranges from about 0.1 to 70 wt %.

A charge transport layer (CTL) 20 is formed on top of the CGL 18 and includes one or more of the electron transport agents of the present invention in a binder. The binder may comprise any of the conventional binders listed above, as well as polycondensation product polymers or specific vinyl polymers having a glass transition temperature greater than about 120° C., as also described in the above-referenced patent application by K. C. Nguyen et al.

As shown in FIG. 1, light hv passes through the electron transport layer 20 and creates electron (–)/hole (+) pairs in the charge generation layer 18. The electrons are transported through the electron transport layer 20 to its outer surface, where they selectively discharge the electrostatic surface charge 21 (denoted as "+"); the holes migrate to the electrically conductive layer 14.

Figure 2:
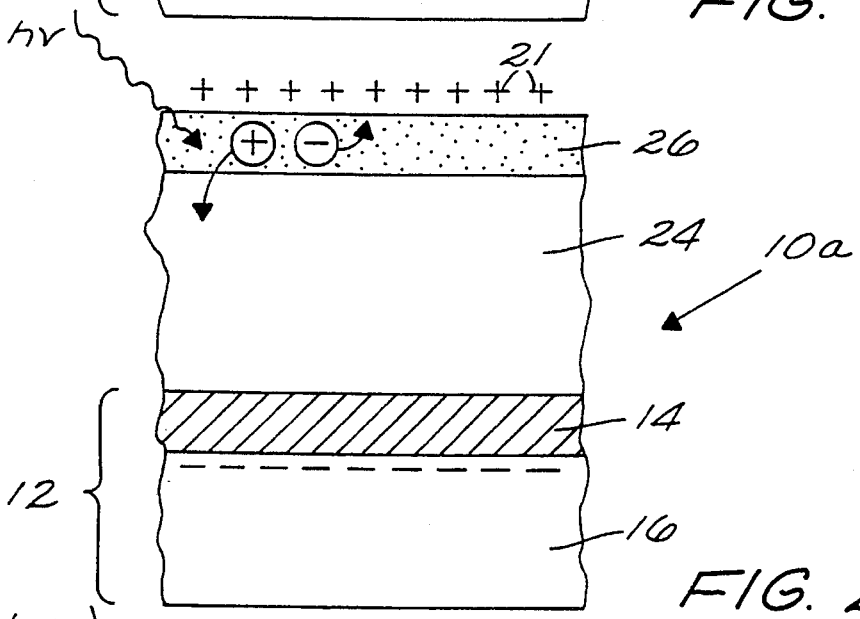
FIG. 2 is a cross-sectional view of another embodiment of a photoconductive generation and transport configuration, using the electron transport agents of the present invention.

In FIG. 2, another photoconductive generation and transport configuration 10*a* is depicted. A hole transport layer 24 is shown formed on the electrically conductive substrate 16. The hole transport layer 24 typically comprises any of the conventional hole transport molecules, including, but not limited to, triaryl methanes, triarylamines, hydrozones, pyrazolines, oxadiazoles, styryl derivatives, carbazolyl derivatives, and thiophene derivatives. In this embodiment, the electron transport and charge generation functions are provided by a single layer 26, which is formed on the CGL 24. The electron transport/charge generation layer 26 contains the electron transport agent(s) of the present invention in a suitable binder. Light hv generates electron/hole pairs in the electron transport/charge generation layer 26. The electrons are transported to the surface of this layer 26, where they selectively discharge the electrostatic surface charge 21; the holes are transported through the hole transport layer 24 to the electrically conductive layer 14.

Figure 3:
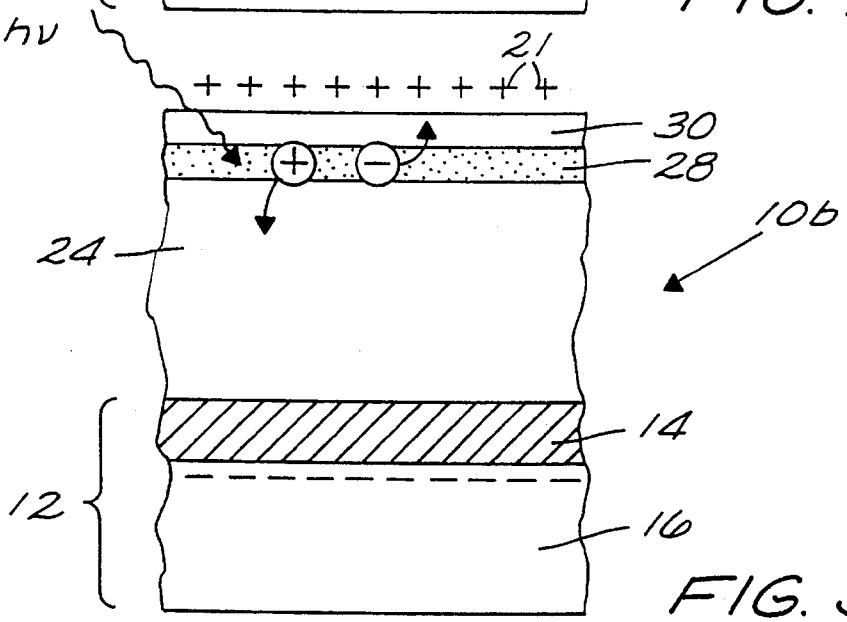
FIG. 3 is a cross-sectional view of yet another embodiment of a photoconductive generation and transport configuration, using the electron transport agents of the present invention.

In FIG. 3, yet another photoconductive generation and transport configuration 10*b* is depicted. The hole transport layer 24 is formed on the electrically conductive layer 14 and in turn supports a separate charge generation layer 28, which typically comprises any of the charge generation molecules (pigments or dyes) in a binder, as described above, and an electron transport layer 30, which is formed on top of the charge generation layer. The electron transport layer 30 contains the electron transport agents of the present invention, again, in a suitable binder and performs as the positive charge injection blocking layer. Light hv generates electron/hole pairs in the charge generation layer 28. The electrons are transported through the electron transport layer 30 to its outer surface, where they selectively discharge the electrostatic surface charge 21; the holes are transported through the hole transport layer 24 to the electrically conductive layer 14.

Figure 4:
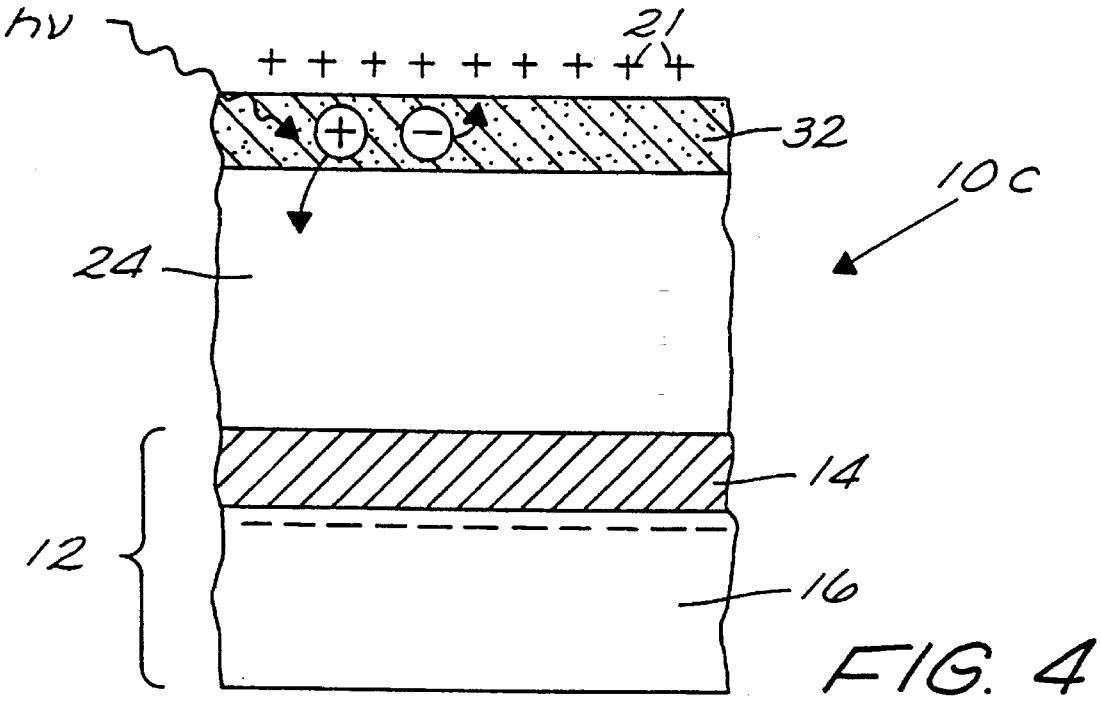
FIG. 4 is a cross-sectional view of still another embodiment of a photoconductive generation and transport configuration, using the electron transport agents of the present invention.

In FIG. 4, still another photoconductive generation and transport configuration 10c is depicted. A layer 32 which contains one or more hole transport molecules, one or more electron transport molecules of the present invention, and provides charge generation, is formed on top of the hole transport layer 24. Light hv generates electron/hole pairs in the charge generation layer 32. The electrons migrate to the outer surface of the charge generation layer 32, where they selectively discharge the electro-static surface charge 21; the holes are transported through the hole transport layer 24 to the electrically conductive layer 14.

Figure 5:
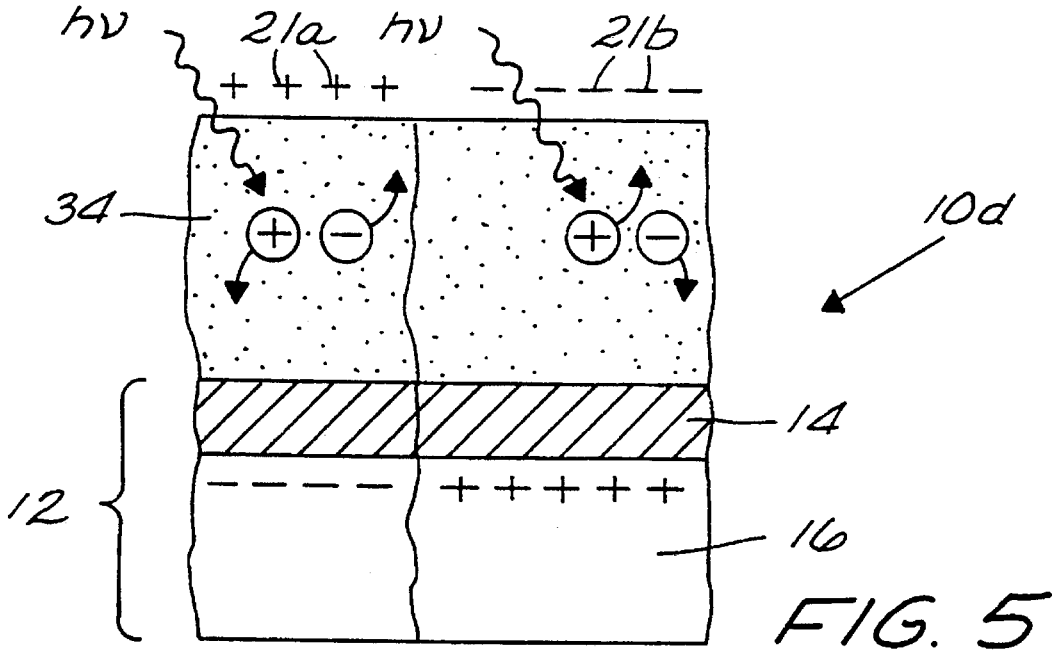
FIG. 5 is a cross-sectional view of a still further embodiment of a photoconductive generation and transport configuration, using the electron transport agents of the present invention.

In FIG. 5, yet a still further photoconductive generation and transport configuration 10*d* is depicted. A single layer 34 contains both the charge transport molecules, including one or more of the electron transport agents of the present invention, and charge generator molecules in a binder. This single layer 34 is formed directly on the conductive layer 14. The nature of the charge (21*a* for positive charge, 21*b* for negative charge) is indicated on the surface of this single layer 34, and may be bipolar, depending on the predominance of the charge transport molecule.

The electron transport agents of the present invention comprise derivatives of diiminoquinilidines represented by formula (I):

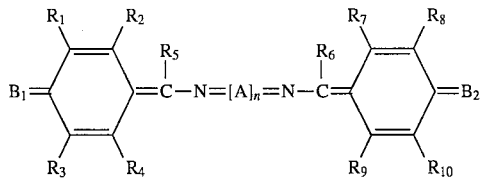

(I)

where A is a moiety selected from the group consisting of =CH—CH=,

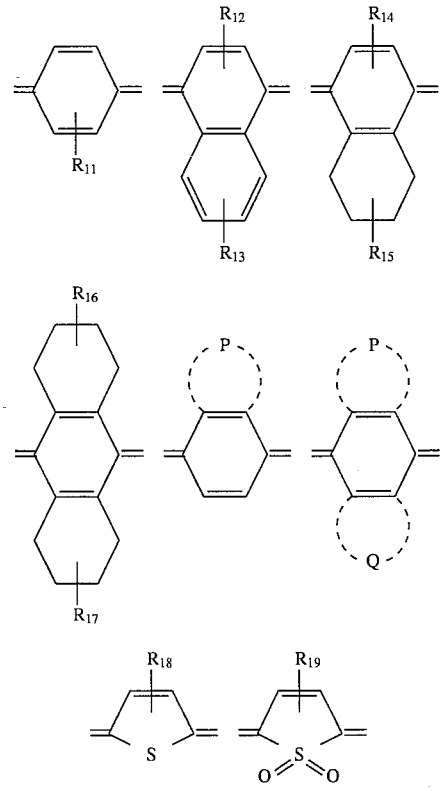

$B_1$ and $B_2$ are independently selected from the group consisting of O, S, Se, Te, dicyano, and alkoxy, and $R_1$ to $R_{20}$ are independently selected from the group consisting of alkyl, alkene, aryl, hydroxy, halogen, cyano, nitro, and sulfuryl, n is an integer within the range of 0 to 3, and

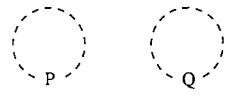

are independently selected from the group consisting of

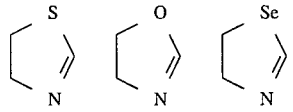

and n is an integer of 0, 1, or 2.

The diiminoquinilidine derivatives of the invention are inexpensive materials, requiring only two steps to synthesize, have excellent solubility and compatibility with most binders due to the presence of long alkyl chains, and evidence high electron mobility.

Particularly preferred compounds include:

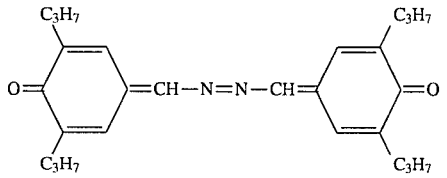
(1)
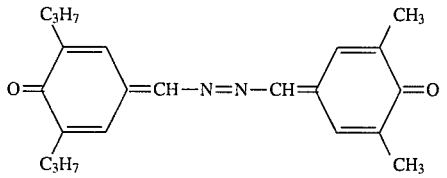
(2)
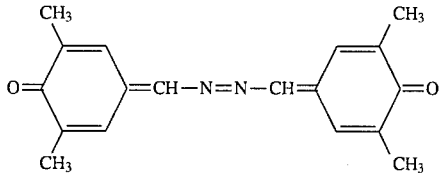
(3)
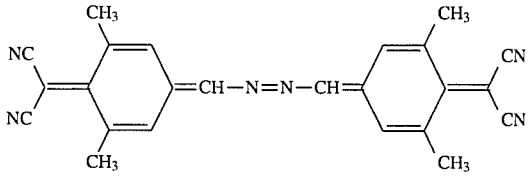
(4)
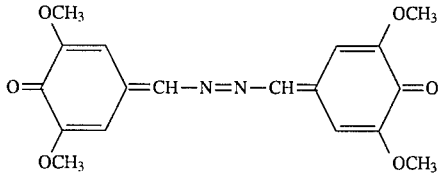
(5)
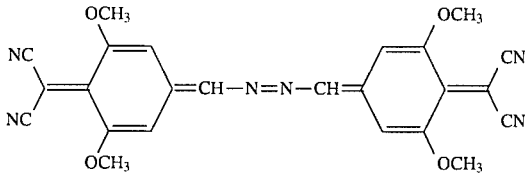
(6)
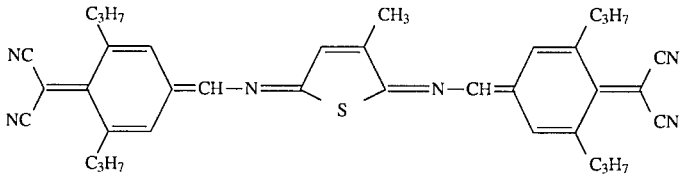
(7)
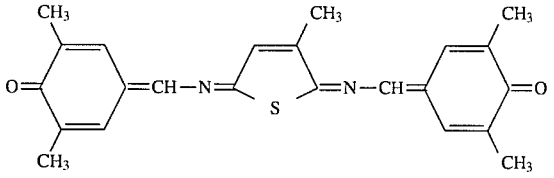
(8)
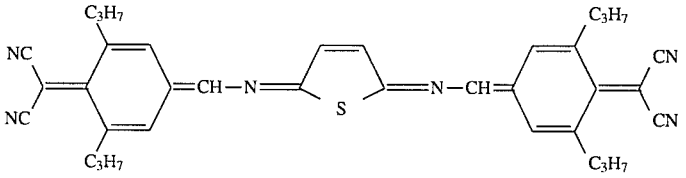
(9)

-continued
(10)
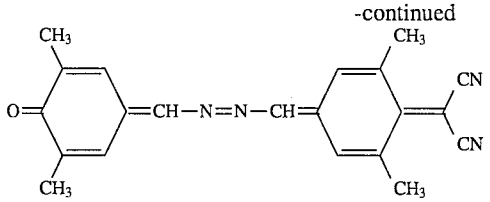
(11)
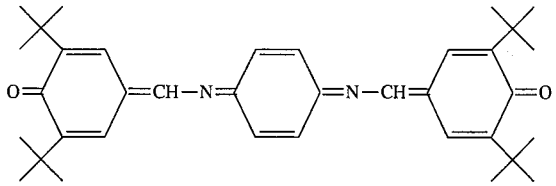
(12)
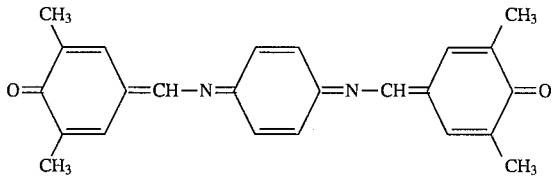
(13)
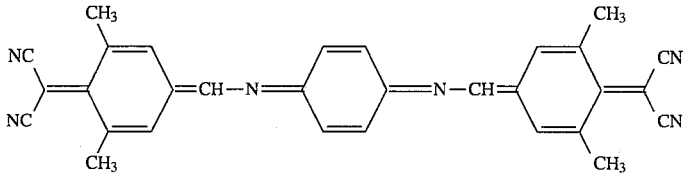
(14)
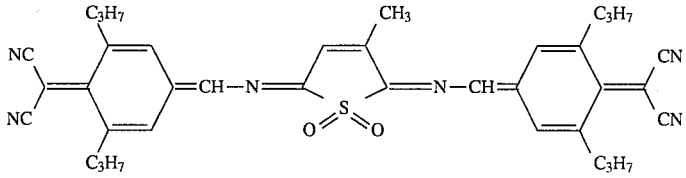
(15)
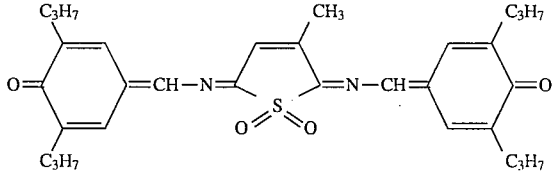
(16)
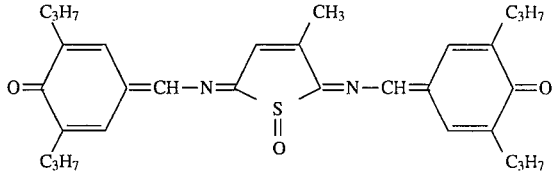
(17)
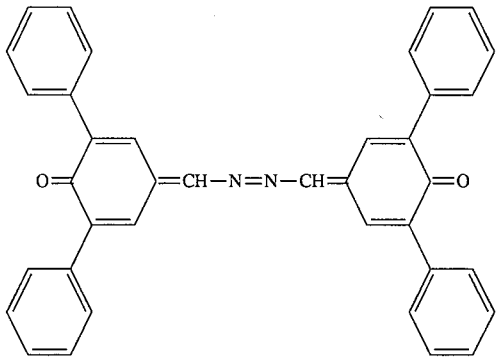

-continued
(18)
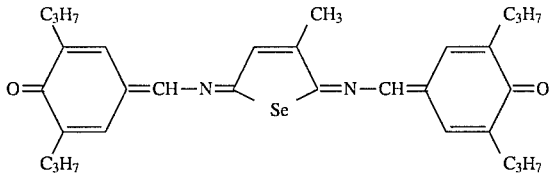
(19)
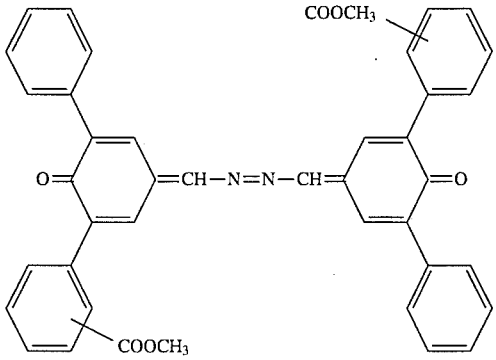
(20)
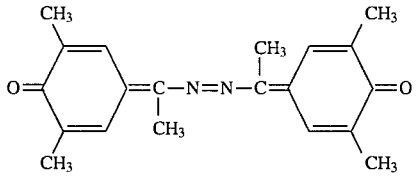
(21)
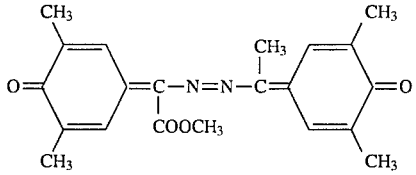
(22)
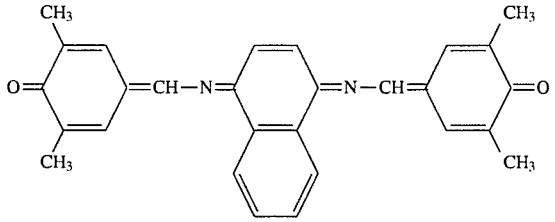
(23)
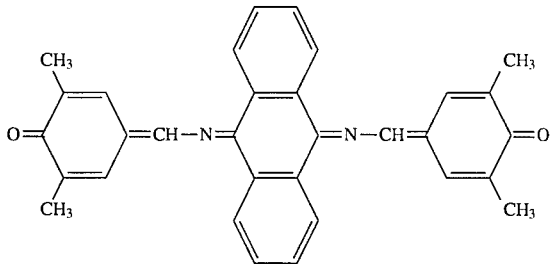
(24)
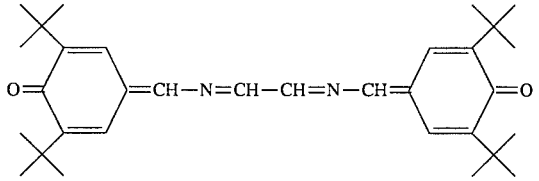

EXAMPLES

Example 1.

A. Preparation of

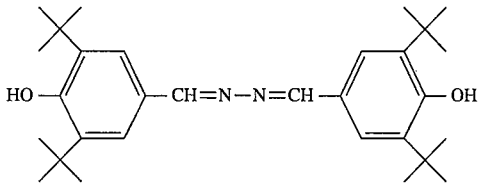

(A)

Chloroform (200 g) was taken in a 500 ml round-bottom flask and degassed with dry nitrogen. 3,5-Di-t-butyl-4-hydroxy benzaldehyde hemihydrate (15.3 g, 62.87 mmol) was added and thoroughly mixed. Hydrazine ( 1 ml, 31.86 mmol) was added and mixed at ambient temperature for ½ hr. The mixture was heated to 48° C. for 48 hr. Solvent was evaporated under vacuum to obtain compound A (13.9 g, 95.3% yield). M.p. of this compound was 236°–245° C.

B. Preparation of

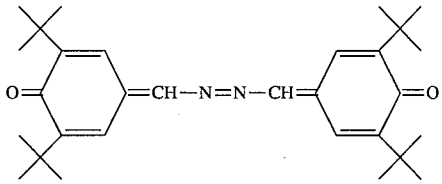

(B)

The phenolic compound A (11.0 g, 23.7 mmol) was dissolved in chloroform (107 g). Potassium permanganate (18.5 g, 117.1 mmol) was added and heated to 52° C. for 21 hrs and at 65° C. for 5 hrs. The reaction mixture was centrifuged and filtered. Solvent from the filtrate was then removed under vacuum. Brown colored solid was obtained (10.54 g, 96.3% yield). This compound upon recrystallization from acetone yielded pure compound. M.p. of this compound was found to be 215°–217° C.

C. Preparation of

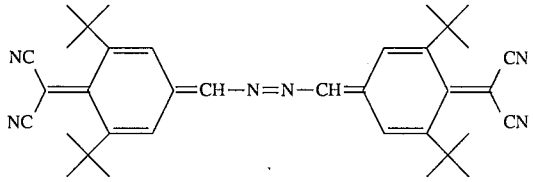

(C)

The oxidized compound B (1.52 g.) was mixed with melononitrile (0.21 g) in methanol (25 g). A small drop of piperidine was added and refluxed at 60° C. for 15 hrs. The temperature was increased to 75° C. for 3 hrs. Methanol was evaporated under reduced pressure. The resulting orange colored solid was washed with water. This solid was dissolved in tetrahydrofuran (15 ml) and precipitated in water (400 ml) and cooled with ice to obtain compound C which was dried in air (yield 1.65 g).

Example 2.

20 g. of the x-form metal-free phthalocyanine pigment, 10 g of polyvinylbutyral B-76 (Monsanto Chemical Co.), 500 g. of dichloromethane (DCM) and stainless steel beads (3 mm diameter) were milled together using a ball mill for 72 hours. The viscosity was adjusted by diluting the solution down to 1% solids. The suspension was coated onto aluminum-coated Mylar using a doctor blade to achieve a 1 μm thick coating after being dried in an oven at 80° C. for a few seconds to form the charge generation layer (CGL).

Next, 40 g of any of compounds (1) to (24), 60 g of polycarbonate Panlite L (Teijin Chemical), and 900 g of DCM were stirred together until completely dissolved. This was the electron transport solution to form the charge transport layer (CTL). The solution was coated on top of the above-mentioned CGL using a doctor blade to achieve a thickness of 20 μm after being dried in an oven at 80° C. for two hours, forming a full construction of a conventional dual layer photoreceptor.

The photoconductor was tested by a drum tester system known as Cynthia 1000, developed by Gentek Co. In this test, the well-grounded photoreceptor specimen was charged by corona charger at +6 kV, rested in dark for 10 seconds, and then exposed to 780 nm light source provided by a combination of halogen lamp, interference filter, and 10 ms electrical shutter. Typical results obtained for the electron transport agents of the present invention are summarized below:

$V_0$=700 V dark decay rate (DDR)=96%

$E_{1/2}$ (energy required to discharge 50% to $V_0$)=4 ergs/cm$^2$ residual voltage after closing the shutter $V_r$=50 V residual voltage after erasure $V_{re}$=0 V.

INDUSTRIAL APPLICABILITY

The derivatives of diiminoquinilidines disclosed herein are expected to find use in electrophotographic printing, especially in color electrophotographic printing.

Thus, there has been disclosed improved electron transport agents comprising derivatives of diiminoquinilidines for electrophotographic printing. It will be readily apparent to those skilled in this art that various changes and modifications of an obvious nature may be made without departing from the scope of the invention, which is defined by the appended claims.

What is claimed is:

1. An electrophotographic element for use in electrophotographic printing, said electrophotographic element including a charge generation region and a charge transport region and formed on an electrically conducting substrate, said charge transport region including at least one electron transport agent having the structure

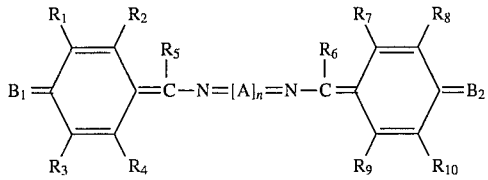

(I)

where A is a moiety selected from the group consisting of =CH—CH=,

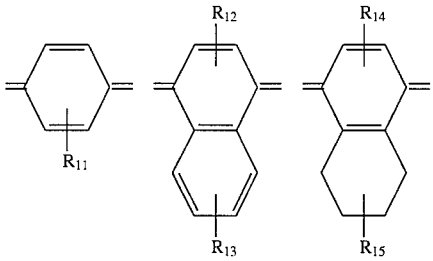

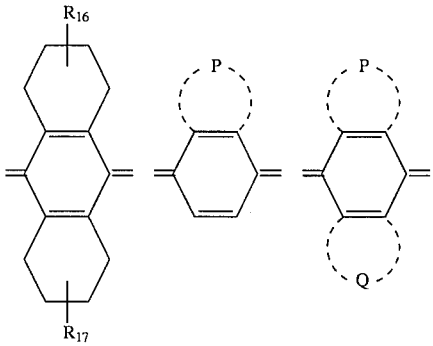

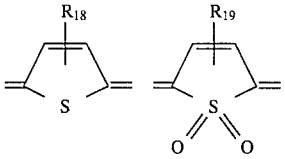

$B_1$ and $B_2$ are independently selected from the group consisting of O, S, Se, Te, dicyano, and alkoxy, and $R_1$ to $R_{20}$ are independently selected from the group consisting of alkyl, alkene, aryl, hydroxy, halogen, cyano, nitro, and sulfuryl, n is an integer within the range of 0 to 3, and

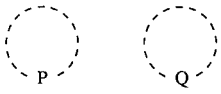

are independently selected from the group consisting of

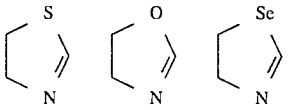

and n is an integer of 0, 1, or 2.

2. The electrophotographic element agent of claim 1 where n=0, $B_1=B_2$ and is O or cyano, $R_1=R_3=R_8=R_{10}$ and is $CH_3$, $C_3H_7$, $OCH_3$, or $C_6H_5$, $R_2=R_4=R_7=R_9=H$, $R_5=CH_3$, and $R_6$ is $CH_3$ or $COOCH_3$.

3. The electrophotographic element agent of claim 1 where n=0, $B_1=O$, $B_2$ is O or cyano, $R_1=R_3=C_3H_7$, $R_8=R_{10}=CH_3$, and $R_2=R_4=R_5=R_6=R_7=R_9=H$.

4. The electrophotographic element agent of claim 1 where n=0, $B_1=B_2=O$, $R_1=R_{10}=C_6H_5$, $R_2=R_4=R_5=R_6=R_7=R_9=H$, $R_{3=R8}=C_6H_4\text{-}COOCH_3$.

5. The electrophotographic element agent of claim 1 where n=1, A is one of

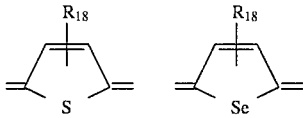

where $R_{18}$ is H or $CH_3$, $B_1=B_2$ and is O or cyano, $R_1=R_3=R_8=R_{10}=CH_3$, $C_3H_7$, $OCH_3$, or $C_6H_5$, and $R_2=R_4=R_5=R_6=R_7=R_9=H$.

6. The electrophotographic element agent of claim 1 where n=1, A=

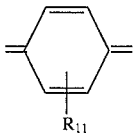

where $R_{11}$ is H, $B_1=B_2$ and is O or cyano, $R_1=R_3=R_8=R_{10}$ and is $CH_3$, $C_3H_7$, or t-butyl, and $R_2=R_4=R_5=R_6=R_7=R_9=H$.

7. The electrophotographic element agent of claim 1 where n=1, A=

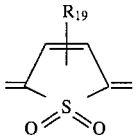

where $R_{19}$ is $CH_3$, $B_1=B_2$ and is O or cyano, $R_1=R_3=R_8=R_{10}=C_3H_7$, and $R_2=R_4=R_5=R_6=R_7=R_9=H$.

8. The electrophotographic element agent of claim 1 where n=1, A=

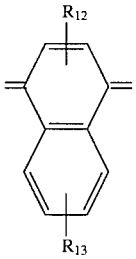

where $R_{12}$ is H or

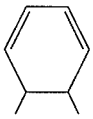

$B_1=B_2=O$, $R_1=R_3=R_8=R_{10}=C_3H_7$, and $R_2=R_4=R_5=R_6=R_7=R_9=H$.

9. The electrophotographic element agent of claim 1 where n=1, A=

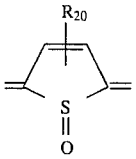

$R_{20}=CH_3$, $B_1=B_2=O$, $R_1=R_3=R_8=R_{10}=C_3H_7$, and $R_2=R_4=R_5=R_6=R_7=R_9H$.

10. The electrophotographic element agent of claim 1 wherein n=1, A=

=CH—CH=

$B_1=B_2=O$, $R_1=R_3=R_8=R_{10}=C_4H_9$, and $R_2=R_4=R_5=R_6=R_7=R_9=H$.

11. The electrophotographic element agent of claim 1 wherein said electrophotographic element comprises a charge transport layer formed on top of a charge generation layer formed on top of said electrically conducting substrate and wherein said electron transport agent is incorporated in said charge transport layer.

12. The electrophotographic element agent of claim 1 wherein said electrophotographic element comprises a combination electron transport/charge generation layer formed on top of a hole transport layer formed on top of said electrically conducting substrate and wherein said electron transport agent is incorporated in said combination electron transport/charge generation layer.

13. The electrophotographic element agent of claim 1 wherein said electrophotographic element comprises an electron transport layer formed on top of a charge generation layer formed on top of a hole transport layer formed on top of said electrically conducting substrate and wherein said electron transport agent is incorporated in said electron transport layer.

14. The electrophotographic element agent of claim 1 wherein said electrophotographic element comprises a combination electron transport and hole transport layer, said combination electron transport and hole transport layer further providing charge generation and formed on top of a hole transport layer formed on top of said electrically conducting substrate and wherein said electron transport agent is incorporated in said combination electron transport and hole transport layer.

15. The electrophotographic element agent of claim 1 wherein said electrophotographic element comprises a single layer incorporating both charge transport and charge generation agents formed on top of said electrically conducting substrate and wherein said electron transport agent is incorporated in said single layer.

16. A method for fabricating an electron transport which includes a charge generation region and a charge transport region, said electrophotographic element formed on an electrically conducting substrate, said method comprising incorporating in said electrophotographic element at least one electron transport agent having the structure

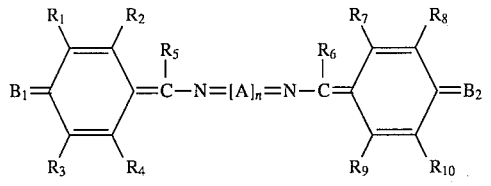

(I)

where A is a moiety selected from the group consisting of =CH—CH=,

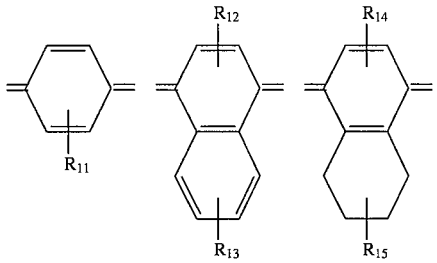

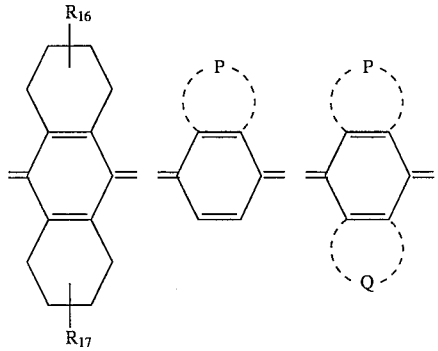

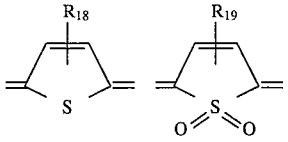

$B_1$ and $B_2$ are independently selected from the group consisting of O, S, Se, Te, dicyano, and alkoxy, and $R_1$ to $R_{20}$ are independently selected from the group consisting of alkyl, alkene, aryl, hydroxy, halogen, cyano, nitro, and sulfuryl, n is an integer within the range of 0 to 3, and

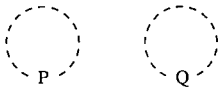

are independently selected from the group consisting of

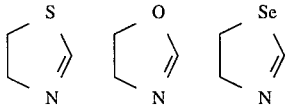

and n is an integer of 0, 1, or 2.

17. The method of claim 16 wherein said at least one electron transport agent is incorporated in a binder in an amount ranging from about 0.1 to 70 wt %.

18. The method of claim 17 wherein said binder is selected from the group consisting of thermoset and thermoplastic polymers having a glass transition temperature lower than about 120° C.

19. The method of claim 18 wherein said binder is selected from the group consisting of polystyrenes, polysilanes, polycarbonates, polyimides, polysilanes, polygermanes, polyesters, and polyvinyl butyrals.

20. The method of claim 16 wherein said at least one electron transport agent is formed as a thin film.

* * * * *